US005838099A

United States Patent [19]

Hichiwa et al.

[11] Patent Number: 5,838,099

[45] Date of Patent: Nov. 17, 1998

[54] DEFLECTION YOKE HAVING FIRST COIL PARTS FOR CORRECTION OF CROSS-MISCONVERGE AND RED/BLUE VERTICAL MISCONVERGE

[75] Inventors: Tsutomu Hichiwa, Koga; Masayuki Shimada, Koshigaya; Masahiko Nakagawa, Syouma-machi; Masaaki Itoh, Iwai, all of Japan

[73] Assignee: Victor Company of Japan, Ltd., Yokohama, Japan

[21] Appl. No.: 805,431

[22] Filed: Feb. 25, 1997

[30] Foreign Application Priority Data

Feb. 26, 1996 [JP] Japan ..... 8-065384

[51] Int. Cl.[6] ..... H01J 29/70

[52] U.S. Cl. ..... 313/440; 313/440; 313/431; 335/213; 335/299

[58] Field of Search ..... 313/440, 431; 335/210, 209, 213, 296, 299

[56] References Cited

U.S. PATENT DOCUMENTS

| | | | |
|---|---|---|---|
| 4,039,988 | 8/1977 | Van Der Heijde | 335/213 |
| 4,431,940 | 2/1984 | Habraken et al. | 313/440 |
| 5,121,028 | 6/1992 | Milili | 313/440 |
| 5,506,469 | 4/1996 | Vink et al. | 313/440 |

FOREIGN PATENT DOCUMENTS

| | | | |
|---|---|---|---|
| 63-4053 | 1/1988 | Japan . | |
| 2-64146 | 5/1990 | Japan . | |
| 2-216738 | 8/1990 | Japan | 313/440 |
| 3-184242 | 8/1991 | Japan . | |

*Primary Examiner*—Sandra L. O'Shea
*Assistant Examiner*—Geraldine Hopkins
*Attorney, Agent, or Firm*—Michael N. Meller

[57] ABSTRACT

This invention provides an improved deflection yoke of a self-convergence system for deflecting electron beams of a color CRT with in-line electron guns for emitting the electron beams, capable of preventing both a vertical misconvergence of R/B lines and a cross-misconvergence at a low cost. The deflection yoke includes at least a pair of saddle type horizontal deflection coils. Each of the saddle type horizontal coils has two main coil sections divided by a window at a center thereof, a front rim forming a front mouth, a rear rim forming a rear mouth and, at least, a first split-winding section nearby one of the front and rear rims. Further, a second split-winding section is provided in the respective two main coil sections in a rear half of the respective two main coil sections. The second split-winding section is divided into two parts, a first coil part positioned close to the window and a second coil part positioned remote from the window, by a small opening. The first coil part has a bent part being bent toward the window to define the small opening.

8 Claims, 5 Drawing Sheets

DEFLECTION YOKE HAVING FIRST COIL PARTS FOR CORRECTION OF CROSS-MISCONVERGE AND RED/BLUE VERTICAL MISCONVERGE

BACKGROUND OF THE INVENTION

1. Field of the Invention

The present invention relates to a deflection yoke of a self-convergence system used for a color cathode ray tube (CRT) of in-line three electron guns horizontally aligned (in in-line formation) for three colors of R, G, B, and particularly relates to improvements of both a cross-misconvergence and a vertical misconvergence of R/B (red and blue) lines in the deflection yoke without increasing dimensions and a production cost of the deflection yoke.

2. Description of the Related Art

The deflection yoke of a self-convergence system has been employed as a method to provide good convergence of the three electron beams emitted from three electron guns and projected on the screen for an image display using a three-electron gun, in-line color cathode ray tube (referred to as in-line color CRT hereinafter).

This type of deflection yoke is designed to form horizontal- and vertical-deflection magnetic fields of pincushion and barrel patters, respectively, by using a pair of saddle-type horizontal deflection coils and a pair of saddle-type vertical deflection coils.

Here, a description is given of a general structure and an operation of the deflection yoke of the self-convergence system, referring to FIGS. 1(A) and 1(B).

FIG. 1(A) is a vertical section of the relevant parts of an in-line color CRT having the deflection yoke mounted thereon viewed along a longitudinal direction (Z-axis) thereof in the prior art, wherein a horizontal-deflection magnetic field having a pincushion pattern formed by a pair of horizontal deflection coils is shown with plural arrows, and small circles shown with reference characters B, G, and R denote blue, green and red electron beams, respectively.

FIG. 1(B) is a vertical section of the relevant part of the in-line color CRT having the deflection yoke mounted thereon viewed along the longitudinal direction (Z-axis) thereof in the prior art, wherein a vertical-deflection magnetic field having a barrel pattern formed by a pair of vertical deflection coils of the deflection yoke is shown with plural arrows, and the small circles shown with reference characters B, G, and R denote blue, green and red electron beams, respectively.

Referring to FIG. 1(A), in an in-line color CRT 8, three electron guns (not shown) are aligned in in-line formation along a horizontal axis (X-axis) in the in-line color CRT 8. Reference characters B, G, and R denote electron beams emitted from the three electron guns. The green beam (G) is usually disposed at the center among the three electron beams B, G and R disposed in this order.

In FIG. 1(A), one horizontal deflection coil 3*c* has two main coil sections (3*c*, 3*c*) positioned in an upper side of the X-axis, and another horizontal deflection coil 3*d* has two main coil sections (3*d*, 3*d*) positioned in a lower side of the X-axis. The pair of the horizontal deflection coils 3*c*, 3*d* is mounted on an outer surface of the in-line color CRT 8.

When a current is applied to the pair of horizontal deflection coils 3*c*, 3*d* in directions as shown in FIG. 1(A) as a "dot" and a "x" which are opposite direction to each other, a horizontal-deflection magnetic field having a pincushion pattern (referred to as pincushion horizontal magnetic field) shown with plural arrows is produced from the pair of horizontal deflection coils 3*c*, 3*d* on an X-Y plane, and is extended along a longitudinal direction (Z-axis) of the color CRT 8.

The pincushion horizontal magnetic field has a characteristic that its intensity is approximately symmetrical with respect to a vertical axis (Y-axis), and becomes stronger at a position remote from the Y-axis in a right or left direction.

On the other hand, in FIG. 1(B), a vertical deflection coil 4*c* has two main coil sections (4*c*, 4*c*) positioned in a left side of the Y-axis, and another vertical deflection coil 4*d* has two main coil sections (4*d*, 4*d*) positioned in a right side of the Y-axis. The pair of the vertical deflection coils 4*c*, 4*d* is mounted on the outer surface of the in-line color CRT 8.

When a current is applied to the pair of vertical deflection coils 4*c*, 4*d* in directions as shown in FIG. 1(B), a vertical deflection magnetic field having a barrel pattern (referred to as barrel horizontal magnetic field) shown with plural arrows is produced therefrom on the X-Y plane.

The barrel vertical magnetic field has a characteristic that its intensity is approximately symmetrical to a horizontal axis (X-axis), and becomes stronger at a position remote from the X-axis in an upper or lower direction.

As a method for adjusting precisely the convergence of the three electron beams B, G, R by using the pairs of horizontal and vertical deflection coils 3*c*, 3*d*, 4*c*, 4*d*, there are such methods as adjusting the magnetic field distribution produced by the pairs of horizontal and vertical deflection coils 3*c*, 3*d*, 4*c*, 4*d*, by adding a compensation circuit to a horizontal or vertical deflection circuit (not shown), or by providing a magnetic material member to an outside of the pairs of horizontal and vertical deflection coils 3*c*, 3*d*, 4*c*, 4*d*.

Thereby, the three electron beams R, G, and B from the three electron guns can be controlled so as to be effectively converged on the screen.

FIG. 2 is a plan view showing one of a pair of horizontal deflection coils viewed from a direction of the Y-axis in the prior art, and FIG. 3 is a front view of the horizontal deflection coils shown in FIG. 2 viewed from a direction of an Z-axis.

The description is given of one of a pair of saddle type horizontal deflection coils 11. The saddle type horizontal deflection coil 11 is wound to have a window 2 at a center thereof. Thus, the saddle type horizontal deflection coil is divided in two main coil sections 11*a*, 11*b* by the window 2. Nearby a front mouth (larger one) of the deflection yoke, there is provided a first split-winding section 3 in the respective two main coil sections 11*a*, 11*b*. In the first split-winding section 3 the winding is divided into four coil parts by three small openings 3*a*. Further, nearby a rear opening (smaller one), there is provided a second split-winding section 4 in the respective two main coil sections 11*a*, 11*b*. In the second split-winding section 4, the winding is divided into three coil parts by two small openings 4*a*. In FIGS. 2 and 3, reference character 7, 8 denote a front rim and a rear rim for physically coupling the main coil sections 11*a*, 11*b* together. The basic shape of the saddle type horizontal deflection coil 11 is depicted in FIG. 6 which is explained hereinafter in the embodiment of the present invention.

As the first and second split-winding sections 3, 4 are provided nearby the front and rear mouths, respectively, it is possible to adjust the pincushion horizontal magnetic field of the saddle type horizontal deflection coils 11 by changing the shapes of the small openings 3*a*, 4*a* and winding numbers of the first and second split-winding sections 3, 4. Thereby, the deflection yoke is designed so that a deflection distortion generated in upper and lower parts of raster on a screen of the color CRT and a horizontal coma error can be be minimized.

FIG. 4 is a schematic view for explaining a cross-misconvergence, and

FIG. 5 is a schematic view for explaining a vertical misconvergence of R/B lines.

However, there is a problem in the prior art that when the magnetic field distribution is adjusted to optimize the deflection distortion generated in the upper and lower parts of raster on the screen, it is apt to generate a cross-misconvergence as shown in FIG. 4 in the magnetic field adjusted.

In order to minimize both the cross-misconvergence and the deflection distortion mentioned above, there is a method to employ a saturable reactor or a rectifier circuit in the prior art. But this method invites an increase of the number of electric components as well as an increase of an assembly cost and dimensions of the apparatus.

On the other hand, as a method to compensate the cross-misconvergence shown in FIG. 4 which occurs after the deflection distortion has been optimized, there is a method to adjust the barrel vertical magnetic field at a low cost, i.e., a method to enforce the intensity of the barrel vertical magnetic field in an area nearby the X axis and to enfeeble the intensity thereof in an area away from the X axis.

However, in this method, as shown in FIG. 5, there is a problem that the electron beam R shown with real lines and the electron beam B shown with dotted lines do not agree with each other at four corners of the screen, resulting in a new problem of a vertical misconvergence of R/B lines where the electron beam R is deviated from the the electron beam B to the right side. This reason is considered that the intensity of the deflection magnetic field in the vertical direction is relatively enfeebled to the intensity of the deflection magnetic field in the horizontal direction at the four corners of the screen because a fact that the intensity of the barrel vertical deflection magnetic field in the area away from the axis X is weaker.

Accordingly, it is obliged to make a compromised design for minimizing both the deflection distortion and the cross-misconvergence equally.

This compromised design does not satisfy the performance demanded on a recent high definition display system utilizing a self-convergence type deflection yoke. Thus, an improvement thereof has been desired.

Next, a description is given of the prior arts similar to the present invention.

(1) Japanese Utility Model Laid-open Publication 63-4053/1988.

The horizontal deflection coil of this prior art has no plural split-windings but a single split-winding extended from the front mouth to the rear mouth. On the other hand, the horizontal deflection coil of the present invention has at least a first split-winding section close to one of the front and rear mouths and the second split-winding section in a rear half of the respective two main coil sections, as mentioned in the preferred embodiment of the present invention.

Thus, in this prior art, the adjustment range of the magnetic field distribution of the horizontal deflection yoke is narrower compared to that of the present invention because it has the same winding number at the front, mid and rear side.

(2) Japanese Utility Model Laid-open Publication 2-64146/1990, and Japanese Patent Publication 7-105206/1995.

In the both prior arts, in a part corresponding to the second split-winding section of the present invention, the coil part remote from a window is bent in a reverse direction toward the window. This causes a bad influence to the other convergence characteristics of the horizontal deflection coil.

In the present invention, the coil part close to the window is only bent toward the window. It should be noted that the direction of the bent part is the reverse direction of the both prior arts. Thereby, both the cross-misconvergence and the vertical misconvergence of the R/B lines are effectively eliminated without affecting other convergence characteristics.

SUMMARY OF THE INVENTION

Accordingly, a general object of the present invention is to provide a self-convergence deflection yoke in which the above disadvantages have been eliminated.

A specific object of the present invention is to provide a self-convergence deflection yoke capable of reducing both the deflection distortion and the cross-misconvergence without inviting an increase of the dimensions of the apparatus and the production cost.

Another specific object of the present invention is to provide a deflection yoke of a self-convergence system for deflecting electron beams of a color CRT containing in-line electron guns for emitting the electron beams, the deflection yoke comprising a pair of saddle type horizontal deflection coils and a pair of saddle type vertical deflection coils, each of the saddle type horizontal coils having two main coil sections divided by a window at a center thereof, a front rim forming a front mouth at a front end of the deflection yoke, a rear rim forming a rear mouth at a rear end of the deflection yoke and, at least, a first split-winding section nearby one of the front and rear rims, the improvement comprising: a second split-winding section being provided in the respective two main coil sections in a rear half of the respective two main coil sections, the second split-winding section being divided into a first coil part positioned close to the window and a second coil part remote from the window by a small opening defined in each of the respective main coil sections, the first coil part having a bent part being bent toward the window.

Another and more specific object of the present invention is to provide a deflection yoke of a self-convergence system for deflecting electron beams of a color CRT containing in-line electron guns for emitting the electron beams, the deflection yoke comprising a pair of saddle type horizontal deflection coils and a pair of saddle type vertical deflection coils, each of the saddle type horizontal deflection coils having two main coil sections divided by a window at a center thereof, a front rim forming a front mouth at a front end of the deflection yoke, a rear rim forming a rear mouth at a rear end of the deflection yoke, a first split-winding section provided nearby the front rim and a second split-winding section provided nearby the rear rim, the improvement comprising: a third split-winding section being provided in the respective two main coil sections in a rear half of the respective two main coil sections, the third split-winding section being divided into a first coil part positioned close to the window and a second coil part remote from the window by a small opening defined in each of the respective main coil sections, the first coil part having a bent part being bent toward the window.

Other objects and further features of the present invention will be apparent from the following detailed description.

DETAILED DESCRIPTION OF THE PREFERRED EMBODIMENT

Figure 6:
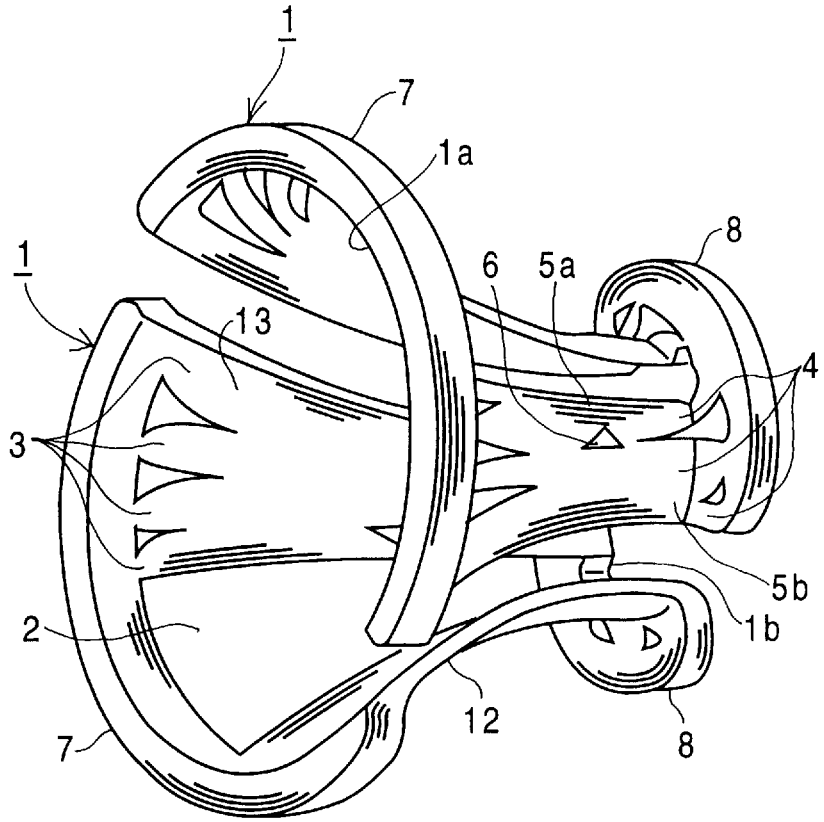
FIG. 6 is a perspective view showing a pair of saddle type horizontal deflection coils in the present invention.
Figure 7:
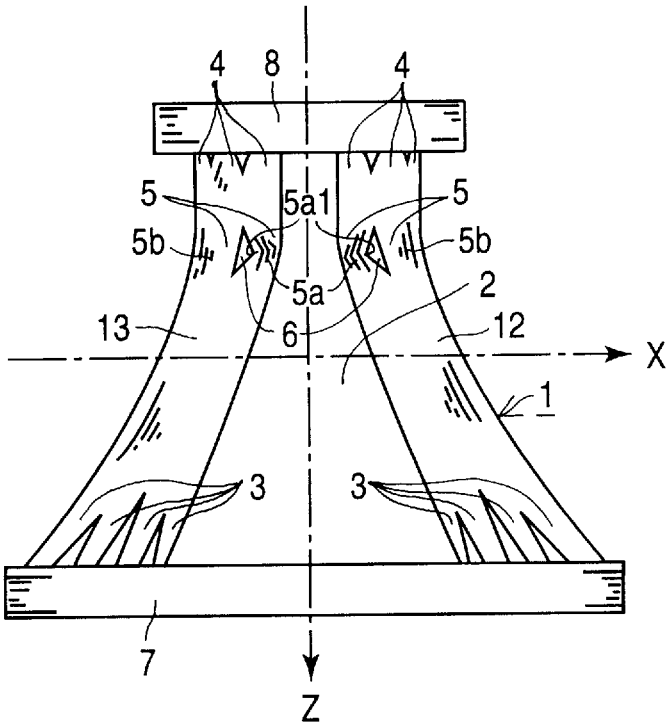
FIG. 7 is a plan view showing one of the pair of saddle type horizontal deflection coils viewed in a direction of an axis Y.
Figure 8:
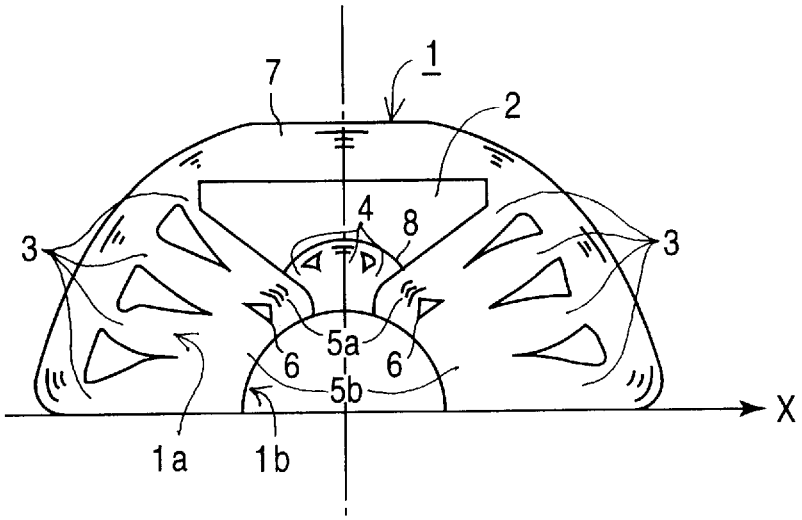
FIG. 8 is a front view of the horizontal deflection coil shown in FIG. 7, viewed in a direction of an axis Z.

Description is given of an embodiment of the deflection yoke of the self-convergence system of the present invention with reference to FIGS. 6 through 8.

The deflection yoke of the present invention generally comprises a pair of saddle type horizontal deflection coils 1, 1 as shown in FIG. 6 and a pair of saddle type vertical deflection coils (not shown) mounted on an outer surface of the color CRT (not shown) with a separator not shown.

Each of the saddle type horizontal deflection coils (referred to as horizontal deflection coils) 1, 1 has generally a saddle shape and is wound to form a window 2 where no wires are provided. The horizontal deflection coil 1 comprises a pair of main winding section 12, 13 formed at both sides of the window 2 interposed between the main winding sections 12, 13 in such a manner that the pair of main winding sections 12, 13 is symmetrical with respective to the Z-axis and extended along the Z-axis to make a truncated cone shape. Each of the horizontal deflection coils 1, 1 is further defined with a horizontal front mouth 1*a* having a large semicircle at a front end of the deflection yoke by a large semicircular rim 7 and a rear mouth 1*b* having a small semicircle at a rear end of the deflection yoke by a small semicircular rim 8 for allowing the horizontal deflection coil 1 to be mounted on a neck of the color CTR (not shown) having a cone shape.

The large and small semicircular rims 7, 8 have a function for connecting the pair of main winding sections 12, 13 at the front and rear ends thereof.

Each of the main winding sections 12, 13 is provided with a first split-winding section 3 nearby the large semicircular rim 7 and a second split-winding section 4 nearby the small semicircular rim 8.

Further, each of the main winding sections 12, 13 is provided with a third split-winding section 5 which is a main feature of the present invention, in a rear half of the main winding section 12 (13).

The third split-winding section 5 is divided into a first coil part 5*a* and a second coil part 5*b* by a small opening 6 having approximately a triangular shape. A bent part 5*a*1 is formed by bending only a part of the first coil part 5*a* in a direction toward the window 2 to define the small opening 6 between the first and second coil parts 5*a*, 5*b*.

Figure 1A:
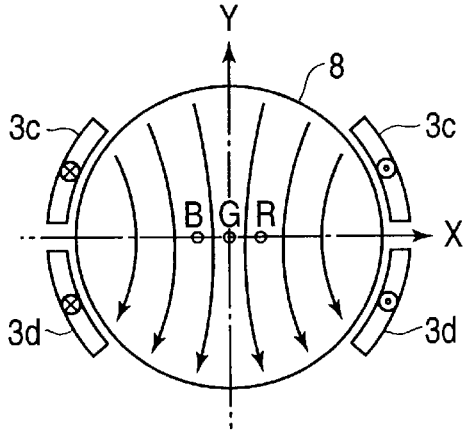
Fig. 1(A) PRIOR ART
FIG. 1(A) is a vertical sectional view of relevant parts of a color CRT and a deflection yoke viewed along a longitudinal direction (Z-axis) thereof in the prior art, wherein a pincushion horizontal magnetic field produced from a horizontal deflection coil of the self-convergence deflection yoke is shown with arrows, and R, G, and B indicate electron beams.
Figure 1B:
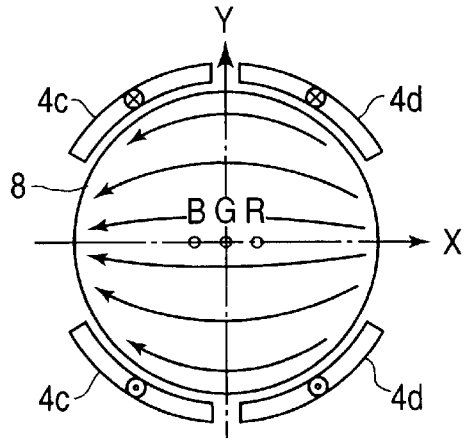
Fig. 1(B) PRIOR ART
FIG. 1(B) is a vertical sectional view of relevant parts of the color CRT and the deflection yoke viewed along the longitudinal direction (Z-axis) thereof in the prior art, wherein a barrel vertical magnetic field produced from a vertical deflection coil of the self-convergence deflection yoke is shown with arrows, and R, G, and B indicate electron beams.

It should be noted that, the self-convergence deflection yoke of this embodiment is further provided with the pair of vertical deflection coils (not shown) as mentioned in the foregoing, however, the basic structure and operation thereof is explained referred to FIG. 1(B). Thus, the detailed description is omitted here.

Next, the description is given of the operation of the deflection yoke having the structure mentioned above.

In each of the horizontal deflection coils 1, of the the present invention, the first and second split-winding sections 3, 4 are provided nearby the front and rear rims 7, 8 respectively, on each the main winding sections 12, 13 as mentioned in the foregoing. Thus, it is possible to adjust easily and partly the intensity of the pincushion horizontal magnetic field produced by the horizontal deflection coils 1. This allows the deflection distortion generated upward and downward on the screen and the horizontal coma error to be minimized, resulting in an optimum adjustment of the horizontal deflection coils 1 in the design and production of the deflection yoke.

Further, as mentioned in the foregoing, each of the main winding sections 12, 13 is provided with the third split-winding section 5 having the bent part 5*a*1 in the first coil part 5*a*, defining the small opening 6 having the triangular shape protruding toward the window 2, located between the mid portion and the second split-winding section 4 at the rear end viewed along a longitudinal direction (z-axis) of the color CRT.

Since the third split-winding section 5 is arranged in such a manner as mentioned above, the pincushion horizontal magnetic field is enfeebled at an area corresponding to the small opening 6 having the triangular shape defined at the position between the mid portion and the rear rim 8 viewed in a longitudinal direction (the direction of the Z-axis).

Figure 9A:
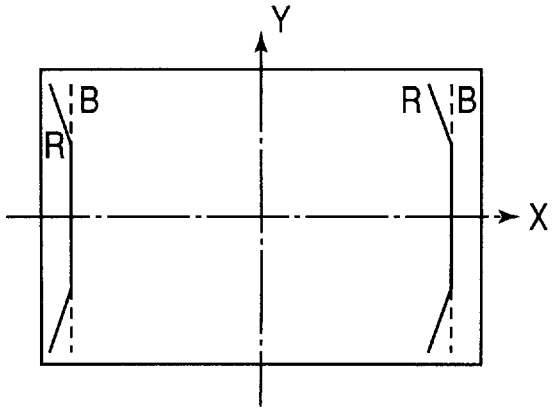
FIGS. 9(A) and 9(B) are schematic views for explaining how to compensate the vertical misconvergence of R/B lines on the screen in the present invention.
Figure 9B:
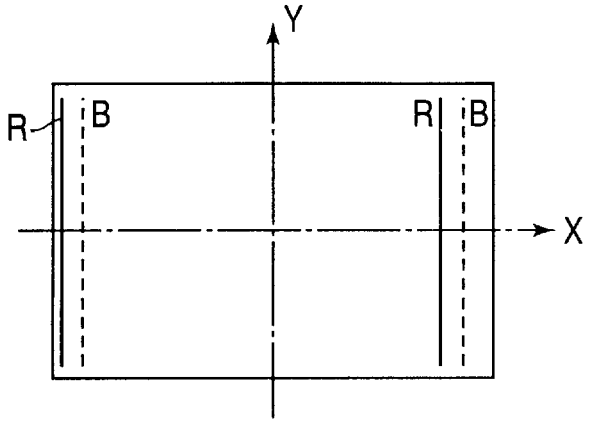

FIGS. 9(A) and 9(B) are schematic views for explaining how to compensate a vertical misconvergence of R/B lines on the screen in the present invention.

This pincushion horizontal magnetic field effects the convergence of the vertical R/B lines in the horizontal direction (X-axis) in such a manner that the overall vertical R line is relatively deviated in the left direction from the vertical B line. In order to correct this convergence of the R/B lines, the first split-winding section 3 is re-designed by a known method in the prior art. As a result, as shown in FIG. 9(A), the vertical R line is relatively deviated in the left direction from the vertical B line at the four corners of the screen.

The amount of the deviation of the vertical R line at the four corners is controlled by the number of windings of the first coil part 5*a* and an angle of the bent part 5*a*1 and the dimension and shape of the small opening 6.

Further, as the bent part 5*a*1 is biassed only in the direction toward the window 2 to form the small opening 6, the second coil part 5*b* having no bent portion is not affected by providing the bent part 5*a*1, resulting in no change of the magnetic field distribution by the second coil part 5*b*.

Figure 4:
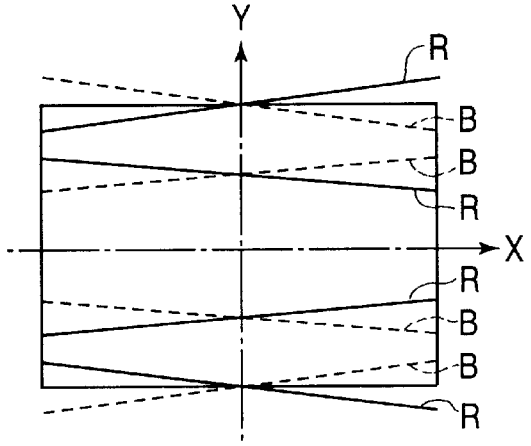
Fig. 4 PRIOR ART
FIG. 4 is a schematic view for explaining a cross-misconvergence in the prior art.
Figure 5:
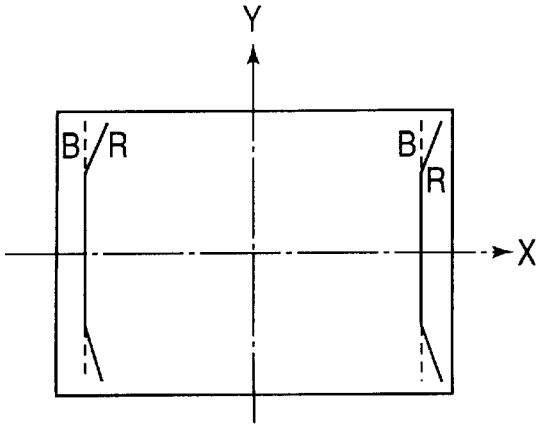
Fig. 5 PRIOR ART
FIG. 5 is a schematic view for explaining a vertical misconvergence of R/B lines in the prior art.
Figure 2:
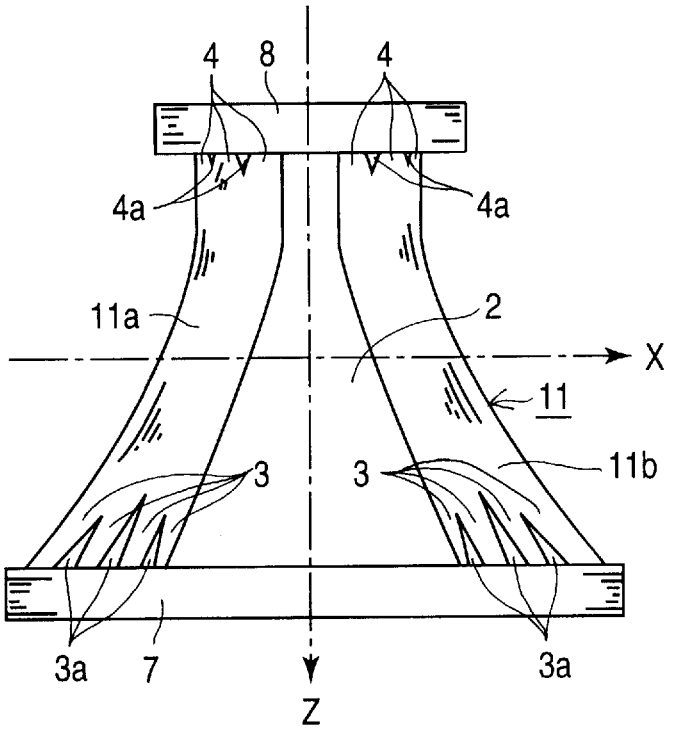
Fig. 2 PRIOR ART
FIG. 2 is a plan view of a horizontal deflection coil viewed in a direction of Y axis in the prior art wherein one of a pair of the horizontal deflection coils is shown.
Figure 3:
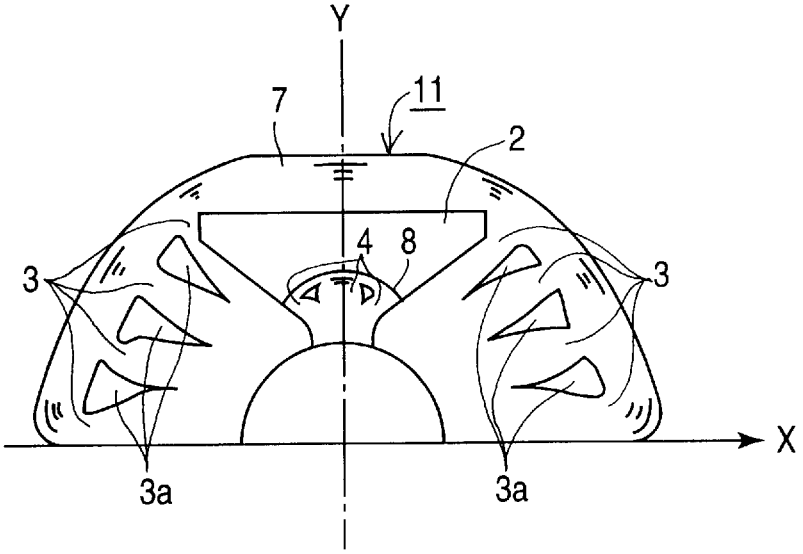
Fig. 3 PRIOR ART
FIG. 3 is a front view of the horizontal deflection coil viewed in a direction of Z axis in the prior art.

Accordingly, in the present invention, as shown in FIG. 9(A), the vertical R line is preliminarily deviated in the left direction at the four corners by an amount corresponding to the amount of the deviation of the vertical R line at the four corners in the right direction shown in FIG. 5, which has been caused by the compensation of the cross-misconvergence shown in FIG. 4. The amount of the preliminary deviation of the vertical R line can be controlled by adjusting the condition of the first coil part 5*a* as mentioned in the foregoing.

Then, after optimizing the deflection distortion developed in the upper and lower parts of the raster of the screen, the cross-misconvergence is corrected by the method mentioned in the foregoing, i.e., the method to enforce the intensity of the barrel vertical magnetic field in an area nearby the X axis and to enfeeble the intensity thereof in the area remote from the X axis.

Accordingly, the amount of the deviation of the vertical R line at the four corners in the right direction, which has been developed by the correction of the cross-misconvergence, is offset by the amount of the preliminary deviation of the vertical R line at the four corners in the left direction. Therefore, the vertical misconvergence of the R/B lines generated by correcting the cross-misconvergence is effectively eliminated.

As mentioned above, according to the embodiment of the self-convergence type deflection yoke of the present invention, both the cross-misconvergence and the vertical misconvergence of the R/B lines are effectively eliminated without affecting other convergence characteristics.

Further, according to the embodiment, it is possible to realize the self-convergence type deflection yoke by changing a shape of the horizontal deflection coils slightly without employing saturable reactors or rectifier circuits without inviting an increase of the dimensions and the production cost of the self-convergence type deflection yoke.

Further, according to the embodiment, it is possible to adjust the distribution of the magnetic field precisely by determining a winding number ratio between the first, second and third split-winding sections 3, 4 and 5 because they are completely independent from each other, thus can be controlled individually.

In this embodiment, as far as the first and second split-winding sections 3, 4 are concerned, they are respectively provided at the rear and front ends of the main coil sections 12, 13, however, it is possible to provide only one split-winding section at either the rear or the front end thereof.

Further, the shape of the small opening 6 interposed between the first and second coil parts 5*a*, 5*b* is not limited to the triangle shape. For instance, a trapezoid shape or a semicircle one may be employed taking account of the amount of the deviation of the vertical R line.

What is claimed is:

1. Deflection yoke of a self-convergence system for deflecting electron beams of a color CRT containing in-line electron guns disposed in a direction of an X axis perpendicular to a longitudinal axis (Z axis) of the color CRT for emitting the electron beams, the deflection yoke comprising a pair of saddle type horizontal deflection coils, and a pair of saddle type vertical deflection coils, each of the saddle type horizontal deflection coils having two main coil sections divided by a window at a center thereof, each extended along the Z axis to make a truncated cone shape, a front coil rim forming a front mouth with a large semicircle extended in a direction of a Y axis perpendicular to the X axis at a front end of the deflection yoke, a rear coil rim forming a rear mouth with a small semicircle extended in the direction of the Y axis at a rear end of the deflection yoke and, at least, a first split-winding section nearby one of the front and rear coil rims, the improvement comprising:

a second split-winding section being provided in the respective two main coil sections in a rear half of the respective two main coil sections, the second split-winding section being divided into a first coil part positioned close to the window and a second coil part remote from the window by a small opening defined in each of the respective main coil sections, the first coil part having a bent part so as to form the small opening being bent toward the window in the direction of the X axis viewed in the direction of the Y axis.

2. Deflection yoke of a self-convergence system as claimed in claim 1, wherein the small opening has a triangle shape.

3. Deflection yoke of a self-convergence system as claimed in claim 1, wherein the small opening has a trapezoid shape.

4. Deflection yoke of a self-convergence system as claimed in claim 1, wherein the small opening has a semicircle shape.

5. Deflection yoke of a self-convergence system for deflecting electron beams of a color CRT containing in-line electron guns disposed in a direction of an X axis perpendicular to a longitudinal axis (Z axis) of the color CRT for emitting the electron beams, the deflection yoke comprising a pair of saddle type horizontal deflection coils, and a pair of saddle type vertical deflection coils, each of the saddle type horizontal deflection coils having two main coil sections divided by a window at a center thereof, each extended along the Z axis to make a truncated cone shape, a front coil rim forming a front mouth with a large semicircle extended in a direction of a Y axis perpendicular to the X axis at a front end of the deflection yoke, a rear coil rim forming a rear mouth with a small semicircle extended in the direction of the Y axis at a rear end of the deflection yoke, a first split-winding section provided nearby the front coil rim and a second split-winding section provided nearby the rear coil rim, the improvement comprising:

a third split-winding section being provided in the respective two main coil sections in a rear half of the respective two main coil sections, the third split-winding section being divided into a first coil part positioned close to the window and a second coil part remote from the window by a small opening defined in each of the respective main coil sections, the first coil part having a bent part so as to form the small opening being bent toward the window in the direction of the X axis viewed in the direction of the Y axis.

6. Deflection yoke of a self-convergence system as claimed in claim 5, wherein the small opening has a triangle shape.

7. Deflection yoke of a self-convergence system as claimed in claim 5, wherein the small opening has a trapezoid shape.

8. Deflection yoke of a self-convergence system as claimed in claim 5, wherein the small opening has a semicircle shape.

* * * * *